United States Patent [19]

Bouilliez

[11] Patent Number: 4,529,853

[45] Date of Patent: Jul. 16, 1985

[54] ELECTRIC CIRCUIT BREAKER WITH SELF BLOW-OUT BY ROTATION OF THE ARC

[75] Inventor: Olivier Bouilliez, Grenoble, France

[73] Assignee: Merlin Gerin, France

[21] Appl. No.: 319,284

[22] Filed: Nov. 9, 1981

[30] Foreign Application Priority Data

Nov. 17, 1980 [FR] France ..... 80 24397

[51] Int. Cl.[3] ..... H01H 33/12; H01H 33/18; H01H 33/98

[52] U.S. Cl. ..... 200/147 R; 200/146 R; 200/148 B

[58] Field of Search ..... 200/148.2, 146 R, 147 R

[56] References Cited

U.S. PATENT DOCUMENTS

| | | | |
|---|---|---|---|
| 592,497 | 10/1897 | Scott | 200/146 A |
| 2,227,507 | 1/1941 | MacNeill | 200/146 |
| 3,032,627 | 5/1962 | Ronk | 200/146 R X |
| 3,211,866 | 10/1965 | Crouch | 200/146 R X |
| 3,390,239 | 6/1968 | Miller | 200/146 R |
| 3,471,666 | 10/1969 | Barkan | 200/148 |
| 3,513,275 | 5/1970 | Cellerini | 200/146 R |
| 3,564,176 | 2/1971 | Fechant | 200/147 R X |
| 3,593,227 | 7/1971 | Mitskevich | 200/147 R X |
| 3,780,244 | 12/1973 | Beatty | 200/148 B |
| 3,858,015 | 12/1974 | Deno | 200/148 B |
| 4,309,581 | 1/1982 | Macaire | 200/148 A |

FOREIGN PATENT DOCUMENTS

| | | | |
|---|---|---|---|
| 0012048 | 6/1980 | European Pat. Off. | 200/147 R |
| 0011972 | 6/1980 | European Pat. Off. | 200/147 R |
| 2339244 | 8/1977 | France | 200/147 R |

*Primary Examiner*—Robert S. Macon

*Attorney, Agent, or Firm*—Parkhurst & Oliff

[57] ABSTRACT

A single pressure sulfur hexafluoride circuit breaker has ring-shaped arcing contacts fixed relative to one another and a magnetic coil electrically connected in the arcing circuit to create a magnetic field for spinning an arc between the arcing contacts. The circuit breaker includes a main circuit and a shunting circuit with stationary and movable contacts arranged so that the main contacts open before the shunting contacts and that the arc drawn between the shunting contacts upon their separation is transferred onto the arcing contacts.

14 Claims, 4 Drawing Figures

ELECTRIC CIRCUIT BREAKER WITH SELF BLOW-OUT BY ROTATION OF THE ARC

BACKGROUND OF THE INVENTION

This invention relates to a single pressure electric circuit-breaker with self blow-out by rotation of the arc under the effect of a magnetic field generated by the current to be interrupted.

The U.S. patent application Ser. No. 87,394 filed 10/22/1979, describes an electric circuit breaker in which the main circuit is laid out almost independently of the auxiliary arcing circuit within the sealed housing of the circuit breaker. This particular arrangement permits a significant simplification of a self gas-blast circuit-breaker of the type known under the trade-name FLUARC, and it was found worthwhile to use this technique in rotating arc circuit breakers. Rotating arc circuit breakers use a magnetic coil inserted in the auxiliary circuit and the increase in the reactance of the auxiliary circuit impedes the rapid transfer of the current onto this auxiliary circuit. In operation arcing occurs on the main contacts as they open.

SUMMARY OF THE INVENTION

The object of the present invention is to eliminate this disadvantage and to provide a rotating arc electric circuit breaker having independent main and arcing circuits, the current commutating rapidly on the arcing circuit.

The circuit breaker according to the present invention comprises arcing contacts designed in the form of facing annular electrodes, and the magnetic coil is mounted against the rear face of one of these electrodes and is connected electrically in series with the arcing contacts so as to generate a radial magnetic field in the gap between the annular electrodes when the arc switches onto the arcing contacts. Shunting or by-pass contacts are set in a shunting or by-pass circuit adjacent to the aforementioned main contacts, which shunting contacts are designed to open after the said main contacts to avoid any arcing on the main contacts. The mobile shunting contact swivels in the vicinity of the aforementioned arcing contacts so as to transfer the arc drawn on the separated shunting contacts onto the arcing contacts.

The presence of a shunting or by-pass circuit means that the opening of the circuit breaker takes place in three distinct phases, namely a first phase during which the main contacts open and the current is commutated onto the by-pass circuit, a second phase during which the shunting contacts open and a arc is drawn between the shunting contacts and a third phase during which the arc is transferred onto the arcing contacts and the magnetic blow-out coil is energized, thereby imposing a fast rotation of the arc on the arcing contacts in the form of annular electrodes or tracks. The mobile shunting contact ensures the transfer of the arc onto the stationary arcing contacts that are placed at an optimum distance for extinguishing the arc.

In one embodiment of the invention, the mobile shunting contact is designed as a pivoting blade, mounted to rotate on the same spindle as the blade forming the main contact. The prior separation of the main contacts is conveniently ensured by a special structure of the shunting contacts, so as to obtain a mechanical connection of the main and shunting mobile contacts. The arcing contacts are placed at a tangent to the path of travel of the mobile shunting contact so as to capture the arc and energize the blow-out coil immediately the shunting contacts are opened.

In another embodiment of the invention, the mobile structure made up of the main and shunting contacts carries a vane which in its travel on opening the circuit breaker, entails a displacement of a gas-blast which facilitates the transfer of the arc from the shunting contacts to the arcing contacts.

The operation of the circuit breaker is extremely simple and the mobile structure is light-weight which facilitates the rapid opening of the contacts.

Other advantages and features of the invention are illustrated more clearly in the following description of a nonrestrictive example of an implementation of the invention, as shown on the attached drawings in which:

DETAILED DESCRIPTION OF PREFERRED EMBODIMENTS

Figure 1:
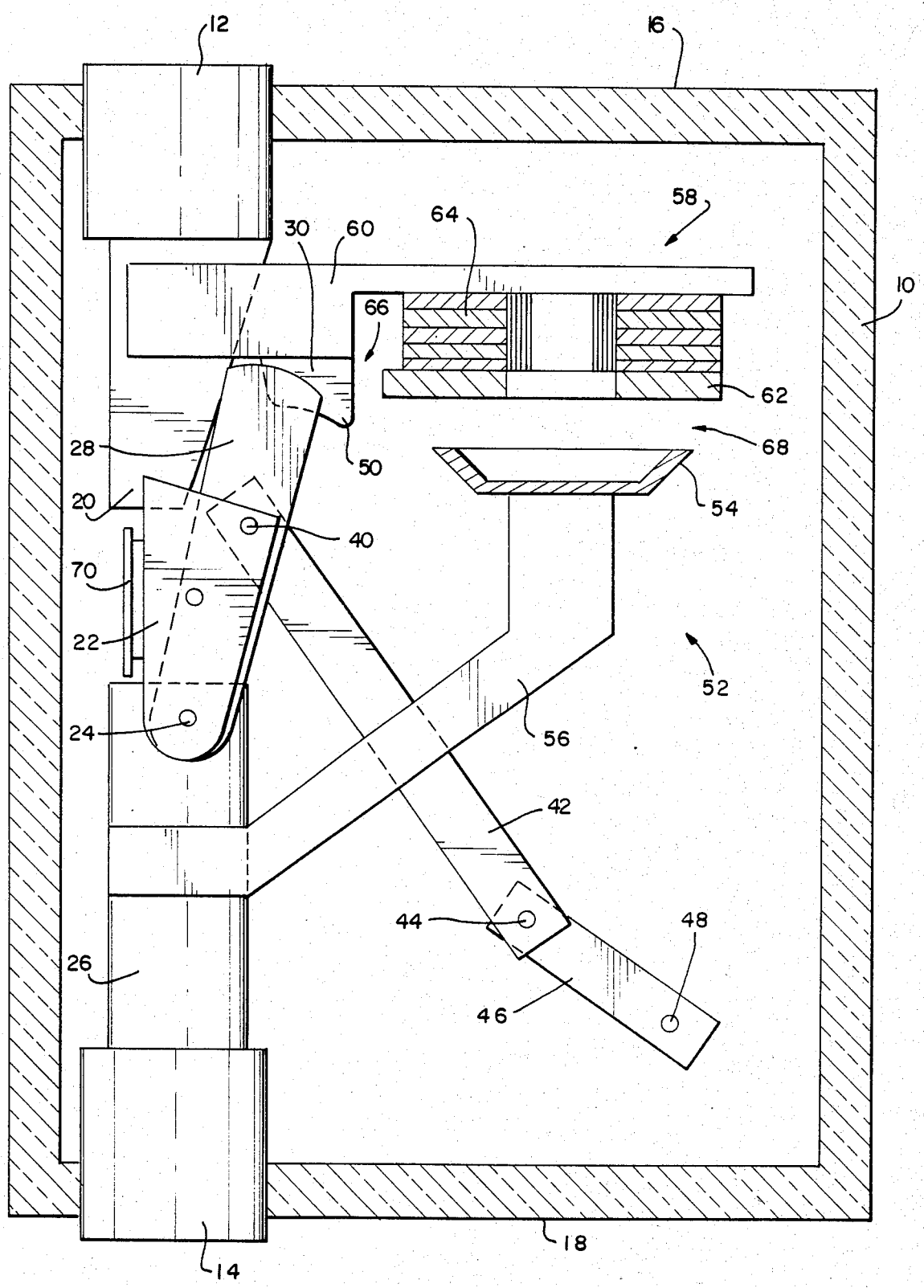
FIG. 1 is a longitudinal cross sectional view of a circuit breaker according to the invention, illustrated in the closed position.

On the figures, a pole unit of a self blow-out circuit breaker comprises a sealed housing or chamber (10) in an insulating material filled with a gas of high dielectric strength, in particular sulphur hexafluoride, at a suitable pressure. Lead-ins or bushings 12, 14, in the form of input and output terminals, come through opposite ends 16, 18 of chamber 10 and form a rectilinear path. Lead-in 12 carries a main stationary contact 20 operating in combination with a main mobile contact 22 in the form of a pivoting blade mounted on a stationary spindle 24, carried by an extension 26 of lead-in 14. In the example illustrated on the figures and referring more especially to FIG. 2, the main mobile contact 22 is made up of two blades 22*a*, 22*b*, which clamp in the closed position areas 20*a*, 20*b*, forming the main stationary contact 20. On the stationary spindle 24 is mounted a rotating shunting or by-pass mobile contact 28, made up of a pair of blades 28*a*, which clamp in the closed position a shunting or by-pass stationary contact 30, connected electrically and mechanically to lead-in 12 by support 32. Compression springs 34 surrounding rod 36 and inserted on either side of blades 22*a*, 22*b*, 28*a*, press the blades of each pair together, so that a tightening pressure is exerted on both the stationary contacts 20*a*, 20*b*, 30, and on extensions 38 of lead-in 14, inserted between the pairs of blades at the level of stationary spindle 24.

The contact pressure of blades 22*a*, 22*b*, 28*a*, is increased by the electro-dynamic forces applied to the contacts in a well-known manner. Blades 22*a*, 22*b*, 28*a* are mechanically connected by a spindle 40 running through holes provided in the blades, and on which the end of a control rod 42 is articulated. The by-pass mobile contact 28 is inserted between blades 22*a*, 22*b* of the main mobile contact 22, and obviously other operating arrangements can be adopted and the main mobile or the by-pass mobile contacts may have a different number of blades, and in particular a single blade.

Figure 4:
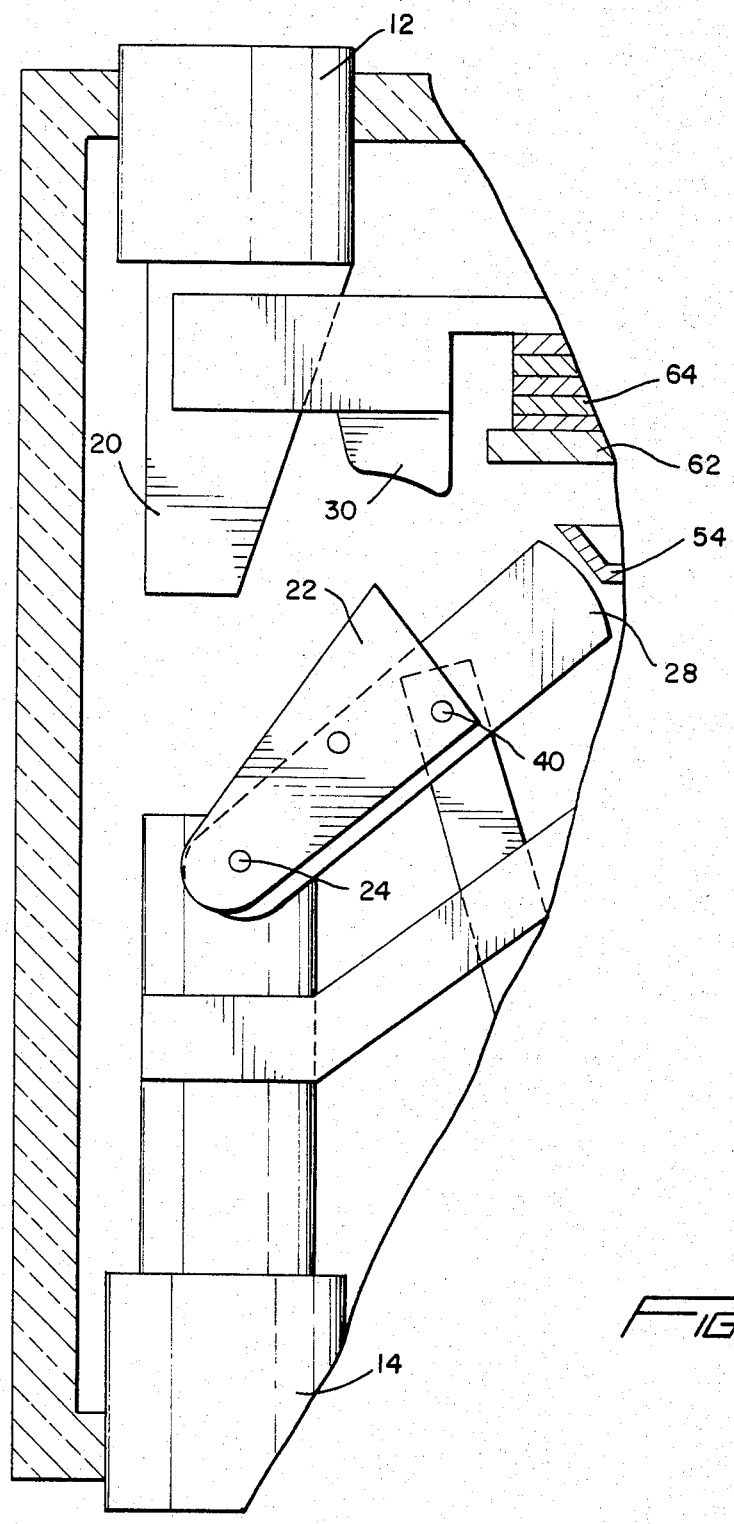

Control rod 42 is articulated by its opposite end to a crank-pin 44 of a crank 46 wedged on a control axle 48 going through the wall of housing 10, and actuated by any type of control mechanism familiar to specialists. When the circuit breaker is in the closed position, illustrated in FIG. 1, the main mobile contact 22 and the by-pass mobile contact 28 lie more or less in a straight line between lead-ins 12, 14, ensuring a practically linear main current flow circuit of minimum length. A rotation of control axle 48 is transmitted by the rod 42—crank 46 assembly to the mobile combination made up of blades 22*a*, 22*b*, 28*a*, so as to pivot these blades on the hinge formed by spindle 24 into the open position, illustrated on FIG. 4, that is almost perpendicular to the initial closed position.

Figure 2:
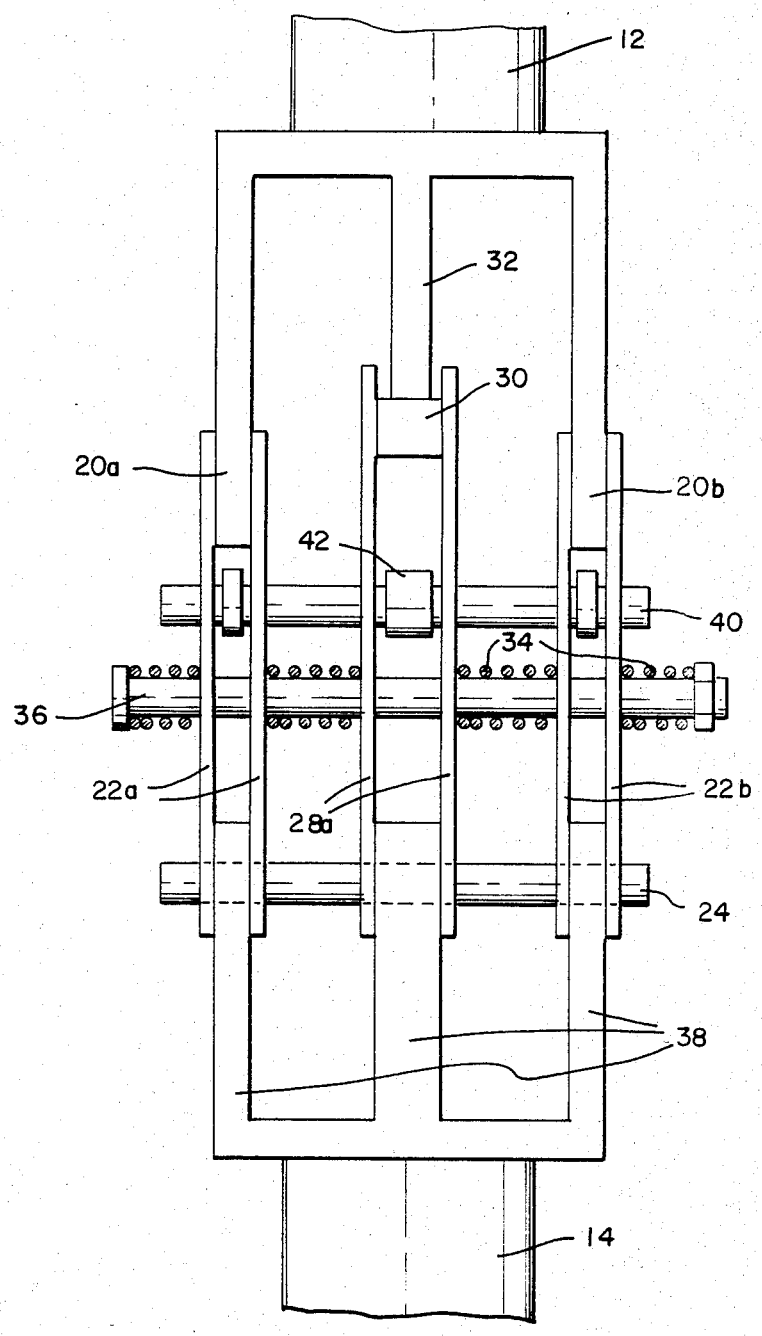
FIG. 2 is a lefthand side view of the main contact and shunting contact arrangement according to FIG. 1.

Blades 28*a* of by-pass contact 28 are longer than blades 22*a*, 22*b* of main contact 22, and the by-pass stationary contact 30, which is higher up on FIG. 2 compared with the main stationary contacts 22*a*, 22*b*, has a part 50 protruding towards the open position when compared with the main stationary contacts 20*a*, 20*b*. This protruding part 50 of by-pass stationary contact 30, results in a separation of the main contacts 22, 20, before the separation of the by-pass contacts 28, 30, when the circuit breaker is opened. The delayed opening of by-pass contacts 28, 30, may naturally be obtained by a different structure of main contacts 20, 22 or of the by-pass mobile contact 28, or be achieved by a particular design of the control mechanism 46, 42. Housing 10 contains in addition an auxiliary circuit 52, comprising a stationary arcing contact 54, connected electrically and mechanically by support 56 to lead-in 14, and a stationary unit 58 coonnected by conducting support 60 to lead-in 12. Stationary unit 58 comprises an acing contact 62 in the form of an annular track arranged facing and at a fixed distance from the stationary arcing contact 54, which is also in the form of an annular track. Stationary unit 58 has in addition a blow-out coil 64, made up of a stack of split discs mounted against the rear face of arcing contact 62. Stationary unit 58 may be of the type described in French Pat. No. 2,464,550, filed on Sept. 3, 1979, which is a convenient reference for more detailed information. It will simply be recalled here that coil 64 is connected in series with arcing contacts 54, 62 in auxiliary circuit 52. Auxiliary circuit 52 is placed laterally with respect to main circuit 20, 22, 26, at an adequate distance to permit an unhampered swivel towards auxiliary circuit 52 of mobile contacts 22, 28. Arcing contact 62, associated with coil 64, is placed at a tangent and at a short gap 66, from the protruding part 50 of by-pass stationary contact 30.

Stationary arcing contact 54 is placed in a similar way at a tangent to the circular path described by the end of the by-pass mobile contact 28. In the circuit breaker open position, illustrated on FIG. 4, the main 22 and by-pass 28 mobile contacts are located behind the arcing contact 54, so as to prevent any re-arcing on mobile contacts 22, 28. An insulating gap 68 separates arcing contacts 54, 62 preventing any current flow in the auxiliary circuit 52 and consequently any current supply to coil 64 when the circuit breaker is in the closed position, illustrated on FIG. 1.

Figure 3:
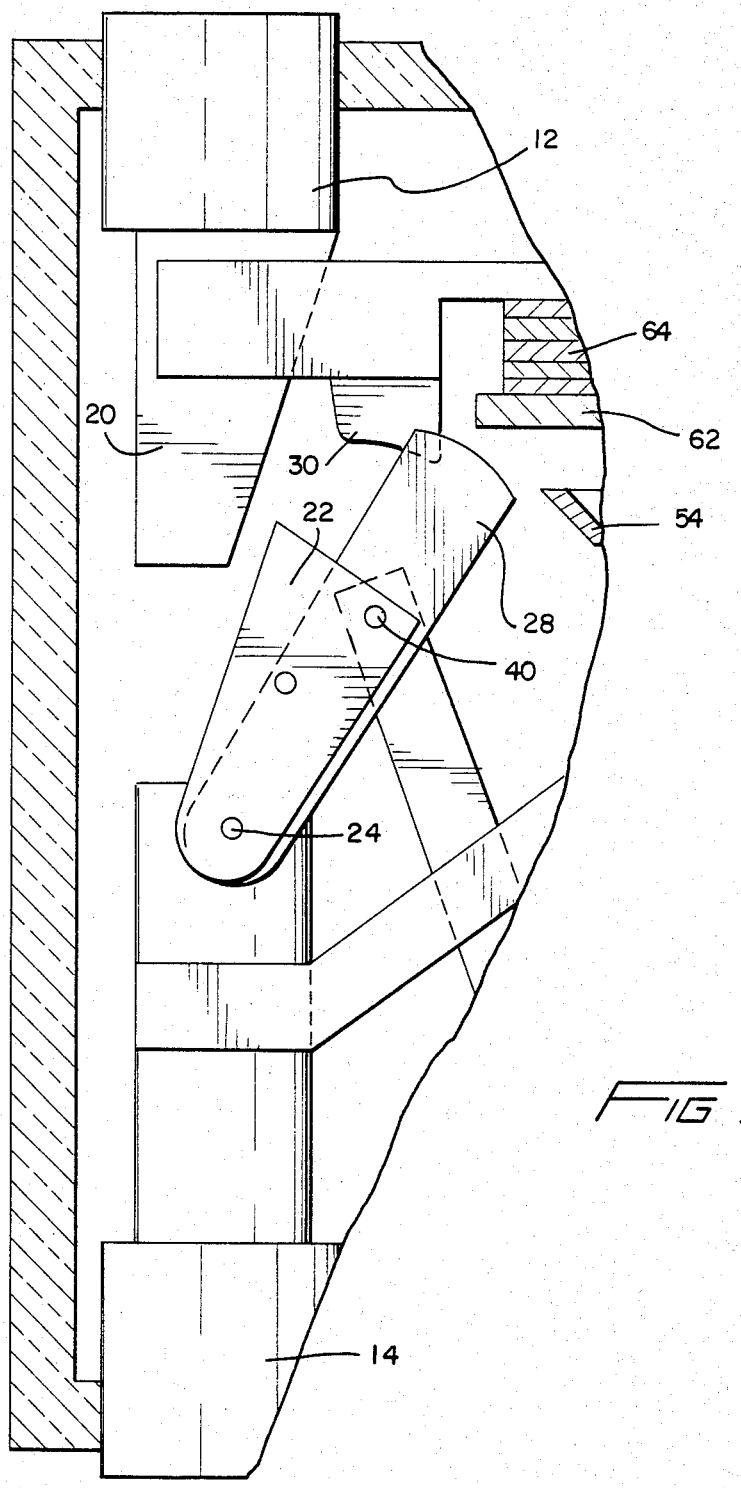
FIGS. 3 and 4 are part views of FIG. 1, showing the contacts while opening and in the open position respectively.

The circuit breaker according to the invention operates in the following manner:

In the closed position, illustrated in FIG. 1, nearly all the permanent current arriving via terminal 12 flows through the main stationary contacts 20*a*, 20*b*, the main mobile contacts 22*a*, 22*b* in the closed position, and leaves via the opposite terminal 14. A small part of the permanent current flows through the by-pass circuit made up of the by-pass stationary contact 30 and the by-pass mobile contact 28. Coil 64 is not energized due to the break in auxiliary circuit 52 formed by insulating gap 68. Heating due to the flow of permanent current is minimum, since the length of the path followed by the current is minimum. When control axle 48 is rotated to actuate an opening, main blades 22*a*, 22*b* and blades 28*a* of by-pass contact 28 are pivoted clockwise, see FIG. 1, by the rod 42, crank 46—assembly. In a midway position, illustrated on FIG. 3, main contacts 20, 22 open while by-pass contacts 28, 30 are still closed. The separation of main contacts 20, 22 entails a commutation of the current onto the by-pass circuit, but without causing an arc, since the reactance of the by-pass circuit is practically identical to that of the main circuit.

Auxiliary circuit 52 remains temporarily unenergized. While blades 22*a*, 22*b*, 28*a* continue their circular movement, by-pass contacts 28, 30 also separate drawing an arc between the protruding part 50 of by-pass stationary contact 30 and the end of the by-pass mobile contact 28. The root of the arc anchored on protruding part 50 transfers rapidly on the adjacent arcing contact 62, energizing blow-out coil 64. At the end of the opening movement, the root anchored on by-pass mobile contact 28 switches onto arcing contact 54 and the arc is blown in rotation on annular contacts 54, 62 by the magnetic field generated by coil 64 in a manner familiar to specialists in the field. Gap 68 corresponds to the optimum distance for arc extinction.

The opening of main contacts 20, 22 which ensure the conduction of permanent current, is shown to occur always without arcing, since the switching arc is drawn between by-pass contacts 28, 30, which take practically no part in the conduction of permanent current. Arcing contacts 54,62 are stationary and serve only to extinguish the arc. The whole assembly is remarkably simple and the mobile combination composed of blades 22*a*, 22*b*, 28*a*, is lightweight. As soon as coil 64 is energized, the switching arc is blown in rotation.

It will be found an advantage to use in association with the mobile combination composed of the main mobile contact 22 and the by-pass mobile contact 28, a plate 70 (FIG. 1) the movement of which entails a displacement of the gas contained in housing 10 towards arcing contacts 54, 62, to blast the arc and facilitate transfer of the arc from by-pass contacts 28, 30 onto arcing contacts 54, 62. The use of blasting plate 70 slightly increases the control power needed, but it remains relatively small compared with the power required in a puffer gas-blast breaker.

It is obvious that the scope of the invention also covers the use of a semi-stationary or mobile arcing contact, or a device in which the mobile blade contacts are replaced by sliding blades or any other type of blade.

I claim:

1. A circuit breaker for providing arc extinction comprising:

a housing having enclosed therein an electrically insulating gas of high dielectric strength;

a pair of input and output terminals extending through said housing;

a main circuit coupled between said input and output terminals and having a stationary contact and a pivotable main contact;

a shunting circuit coupled between said input and output terminals and having a stationary contact and a pivotable shunting contact;

an arcing circuit disposed laterally of said main and shunting contact, having a pair of ring shaped arcing contacts, one of which is coupled to said output terminal and the other of which is coupled to said input terminal;

an electrical coil electrically coupled in said arcing circuit and magnetically coupled to said pair of arcing contacts for producing a magnetic field for spinning an arc when an arc is created between said pair of ring shaped arcing contacts; and means coupled to said pivotable main and shunting contacts for moving said pivotable contacts from a closed position wherein said pivotable main and shunting contacts electrically couple said input and output terminals to one another through said stationary contacts to a laterally displaced open position adjacent said arcing circuit wherein said pivotable main and shunting contacts provide an electrically open circuit between said input and output terminals, said arcing contacts being spaced laterally adjacent a travel path of the pivotable shunting contact as the pivotable shunting contact is moved from the closed position to the open position, said pivotable main and shunting contacts being constructed and arranged with respect to said stationary contacts such that said pivotable main contact is moved to said open position by said means for moving prior to said pivotable shunting contact, so that drawing of an arc between the stationary contact and the pivotable main contaact is inhibited and, upon movement of said pivotable shunting contact to said open position, an arc is drawn between said pivotable shunting contact and said stationary shunting contact and transferred to said arcing contacts.

2. The circuit breaker of claim 1 wherein said pivotable shunting contact comprises a pivotally mounted contact plate having an end portion swiveling in the vicinity of said arcing contacts, said ring shaped arcing contacts being formed as two stationary ring shaped contacts.

3. The circuit breaker of claim 1 wherein said pivotable main movable contact is a pivoting blade having a first length and said pivotable shunting contact is a pivoting blade having a second length, said pivotable main contact and said pivotable shunting contact being pivoted about a common axis and said second length being greater than said first length.

4. The circuit breaker of claim 1 further comprising a blast plate coupled to move with said pivotable main and shunting contacts and constructed and arranged to blast an arc drawn between said pivotable shunting and stationary contacts with insulating gas to move an arc toward said arcing contacts to aid said arc transfer.

5. The circuit breaker of claim 1 wherein, upon movement of said pivotable main and shunting contacts to said open position, a distance between said arcing contacts is less than a distance between said pivotable main and shunting contacts and said stationary main and shunting contacts, respectively.

6. A circuit breaker system comprising:

at least one first electrical terminal;

at least one second electrical terminal;

at least one first pivotable electrical contact coupled to one of said first and second electrical terminals and coupled for pivotable movement between first and second positions wherein said first pivotable contact forms a closed electrical path between said first and second terminals in said first position and an open electrical path between said first and second terminals in said second position;

at least one second pivotable electrical contact coupled to one of said first and second electrical terminals and pivotable between first and second positions wherein said second pivotable electrical contact forms an electrically closed path between said first and second terminals in said first position and an electrically open path between said first and second terminals in said second position;

at least one third electrical contact of annular shape coupled to said first electrical terminal and at least one fourth electrical contact of annular shape coupled to said second electrical terminal, said third and fourth electrical contacts forming an arcing circuit and being positioned laterally adjacent a travel path of said second electrical contact as said second electrical contact moves between said first and second positions;

means for moving said first and second electrical contacts between said first and second positions, said first and second electrical contacts being positioned with respect to one another such that upon movement from said first position to said second position, said first electrical contact produces said open electrical path prior to said second electrical contact and said second electrical contact moves laterally adjacent to said third and fourth electrical contacts, thereby inhibiting the drawing of an arc between said first movable contact and one of said first and second electrical terminals; and means for generating a magnetic field for extinguishing an arc by rotation about said third and fourth electrical contacts.

7. The system of claim 6 wherein said first electrical contact is a primary current carrying contact and said second electrical contact is a shunting electrical contact, and said third and fourth electrical contacts are arcing contacts, said shunting electrical contact being positioned to establish an arc upon movement from said first position to said second position due to current flow between said first and second terminals and moved by said means for moving to transfer said arc to said arcing circuit for subsequent extinction.

8. The system of claim 7 wherein said means for generating a magnetic field comprises a coil electrically coupled in series with said third and fourth electrical contacts.

9. The system of claim 6 wherein said first and second electrical contacts are blades having first and second lengths, respectively, and are coupled to said first terminal for pivotal movement about a common axis, said second length being greater than said first length.

10. The system of claim 6 wherein said electrically closed paths formed by said first and second electrical contacts in said first position have substantially the same electrical reactance.

11. The system of claim 6 wherein a distance between said third and fourth electrical contacts is less than a distance between said first and second pivotable contacts and one of said first and second electrical terminals when said first and second movable contacts move to said second position.

12. In an electrical circuit breaker system having input and output terminals coupled to a current source, and a circuit breaker coupled between said input and output terminals for interrupting the circuit and extinguishing an arc which is created during the circuit interruption, the improvement in said circuit breaker comprising:

a first electrical contact pivotably coupled to one of said input and output terminals and movable between a first position forming an electrically closed current carrying path between said input and output terminals and a second position forming an electrically open path between said input and output terminals;

a second electrical contact pivotably coupled to one of said input and output terminals and movable between a first position forming an electrically closed current carrying path between said input and output terminals and a second position forming an electrically open path between said input and output terminals;

a first annular arcing contact coupled to one of said input and output terminals;

a second annular arcing contact coupled to the other of said input and output terminals and laterally spaced from said first arcing contact;

means for moving said first and second electrical contacts between said first position and said second position, said second position of said second electrical contact being laterally adjacent said first arcing contact, said first and second electrical contacts being constructed and arranged such that said first electrical contact moves to said second position prior to said second electrical contact in such a manner that upon movement of said second electrical contact to said second position, an arc is created between said second electrical contact and the other of said input and output terminals and transferred from said second electrical contact to said annular arcing contacts, a distance between said first and second arcing contacts being less than a distance between said first and second electrical contacts and one of said input and output terminals; and means for generating a magnetic field for extinguishing said arc by rotation about said first and second annular arcing contacts.

13. The system of claim 12 wherein said first and second electrical contacts have first and second lengths, respectively, said second length being greater than said first length.

14. The system of claim 12 further comprising a housing enclosing said circuit breaker and filled with sulfur hexafluoride as an insulating gas.

* * * * *